US012110898B1

(12) United States Patent
Zheng

(10) Patent No.: US 12,110,898 B1
(45) Date of Patent: Oct. 8, 2024

(54) DISASSEMBLABLE FAN BLADE AND CEILING FAN LIGHT

(71) Applicant: JOININ GLOBAL PTE.LTD., SG (SG)

(72) Inventor: Hongbing Zheng, Hangzhou (CN)

(73) Assignee: JOININ GLOBAL PTE. LTD., Singapore (SG)

( * ) Notice: Subject to any disclaimer, the term of this patent is extended or adjusted under 35 U.S.C. 154(b) by 0 days.

(21) Appl. No.: 18/436,035

(22) Filed: Feb. 8, 2024

(30) Foreign Application Priority Data

Nov. 22, 2023 (CN) ..... 202323161860.7

(51) Int. Cl.
*F04D 25/08* (2006.01)
*F04D 29/38* (2006.01)

(52) U.S. Cl.
CPC ..... *F04D 25/088* (2013.01); *F04D 29/388* (2013.01)

(58) Field of Classification Search
CPC . F04D 25/088; F21V 33/0096; F24F 2221/14
See application file for complete search history.

(56) References Cited

U.S. PATENT DOCUMENTS 871,729 A * 11/1907 Mcchord ..... B64C 11/065 416/207
1,361,785 A * 12/1920 Tucker ..... F04D 29/382 416/142
4,640,668 A * 2/1987 Yang ..... H02K 11/23 310/68 E
4,662,823 A * 5/1987 Cooke ..... F04D 29/36 D23/385
4,776,761 A * 10/1988 Diaz ..... F04D 29/366 416/142
5,944,486 A * 8/1999 Hodgkins, Jr. ..... F04D 25/088 416/207
6,155,787 A * 12/2000 Hodgkins, Jr. ..... F04D 25/088 416/220 R
6,213,716 B1 * 4/2001 Bucher ..... F04D 29/388 416/142
6,669,446 B2 * 12/2003 Hodgkins, Jr. ..... F04D 25/088 416/210 R
6,821,091 B2 * 11/2004 Lee ..... F04D 29/34 416/207
8,142,156 B2 * 3/2012 Wiegel ..... F04D 25/088 169/46
9,528,529 B1 * 12/2016 Kraft ..... F04D 29/384
9,726,192 B2 * 8/2017 Whitley ..... F04D 29/325
(Continued)

*Primary Examiner* — Eldon T Brockman
(74) *Attorney, Agent, or Firm* — IPRTOP LLC

(57) ABSTRACT

A disassemblable fan blade and a ceiling fan light. The disassemblable fan blade includes an outer fan blade, an inner fan blade, and a fixing member. The outer fan blade is detachably connected to the inner fan blade, and the fixing member is used to connect the outer fan blade and the inner fan blade. The outer fan blade and the inner fan blade are connected at an angle. Due to the outer fan blade being connected to the inner fan blade at an angle, the blowing area of the fan is increased. The fan blade includes two sections, that is the inner fan blade and the outer fan blade, which reduces the packaging volume for transportation and increases the utilization of packaging space, thus reducing transportation costs and making it less prone to damage.

9 Claims, 3 Drawing Sheets

(56) References Cited

U.S. PATENT DOCUMENTS

| | | | | |
|---|---|---|---|---|
| 2001/0016164 | A1* | 8/2001 | Hodgkins, Jr. | F04D 29/34 416/210 R |
| 2008/0253896 | A1* | 10/2008 | Walls | F04D 25/088 416/223 R |
| 2010/0034651 | A1* | 2/2010 | Wiegel | F04D 25/088 169/70 |
| 2016/0290357 | A1* | 10/2016 | Whitley | F04D 19/002 |

* cited by examiner

DISASSEMBLABLE FAN BLADE AND CEILING FAN LIGHT

TECHNICAL FIELD

The present disclosure relates to the technical field of ceiling fans, particularly to a disassemblable fan blade and a ceiling fan light.

BACKGROUND OF THE INVENTION

Ceiling fan lights are electrical appliances that combine the functions of the ceiling light and the ceiling fan. In addition to their basic functions such as lighting and ventilation, many further serve as ornaments, of which, the common ones on the market include traditional straight-blade fan lights and hidden-blade fan lights. Others may be used as auxiliary appliances to improve the efficiency of air conditioners. Ceiling fan lights are beautiful, can be equipped with fan blades and luminaires with different colors and styles, and have functions such as lighting, cooling, and decoration.

The blades of leaf-blade ceiling fan lights on the market are generally flat, so there are few differentiations among them. Due to the large length of the blades, a large packaging space is required, however, there is a significant waste of the packaging space, which results in low utilisation of the packaging space, leading to high transportation costs and easy damage.

SUMMARY OF THE INVENTION

The present disclosure provides a disassemblable fan blade and ceiling fan light to solve the problems of low packaging space utilization and easy damage caused by the length of the fan blades.

In the first aspect, the present disclosure provides a disassemblable fan blade, which includes an outer fan blade, an inner fan blade, and a fixing member. The outer fan blade is configured to be detachably connected to the inner fan blade, and the fixing member is used to connect the outer fan blade and the inner fan blade.

In one embodiment of the first aspect, the outer fan blade is configured to be connected to the inner fan blade through the fixing member, at which time the outer fan blade and the inner fan blade are in the same plane In one embodiment of the first aspect, the outer fan blade is configured to be connected to the inner fan blade at an angle to increase the blowing area.

In one embodiment of the first aspect, the fixing member includes a front cover plate and a rear cover plate, where the front cover plate is configured to be connected to lower contact surfaces of the outer fan blade and the inner fan blade, and the rear cover plate is configured to be connected to upper contact surfaces of the outer fan blade and the inner fan blade.

The front cover plate and the rear cover plate are configured to be connected to the outer fan blade and the inner fan blade by multiple fastening members.

In one embodiment of the first aspect, a connecting end of the outer fan blade and a connecting end of the inner fan blade are respectively provided with multiple connecting holes for detachably connecting the outer fan blade and the inner fan blade.

In one embodiment of the first aspect, multiple ends of the front cover plate and multiple ends of the rear cover plate are respectively provided with multiple screw holes for connecting the outer fan blade and the inner fan blade, where the screw holes correspond to the connecting holes. The fastening members pass through the screw holes and the corresponding connecting holes to connect the outer fan blade and the inner fan blade.

In one embodiment of the first aspect, a limiting plate is provided on each of the two sides of the front cover plate to assist in connecting the inner fan blade and the outer fan blade.

In one embodiment of the first aspect, the screw holes protrude from the front cover plate, and a height of the protruding screw holes on the front cover plate is less than a height of the limiting plate, so as to facilitate the connection of the inner fan blade and the outer fan blade.

In one embodiment of the first aspect, a contact surface between the front cover plate and the outer fan blade is at a first angle with a contact surface between the front cover plate and the inner fan blade. The first angle is complementary to a lower connecting angle between the outer fan blade and the inner fan blade.

In one embodiment of the first aspect, a contact surface between the rear cover plate and the outer fan blade is at a second angle with a contact surface between the rear cover plate and the inner fan blade. The second angle is complementary to an upper connecting angle between the outer fan blade and the inner fan blade.

In a second aspect, the present disclosure provides a ceiling fan light, including any one of the disassemblable fan blades as described in the first aspect.

As described above, the disassemblable fan blade and the ceiling fan light of the present disclosure have the following beneficial effects:

due to the outer fan blade being connected to the inner fan blade at an angle, the blowing area of the fan is increased. The fan blade in the present disclosure includes two sections, that is the inner fan blade and the outer fan blade, which reduces the packaging volume for transportation and increases the utilization of packaging space, thus reducing transportation costs and making it less prone to damage.

REFERENCE NUMERALS

Figure 1:
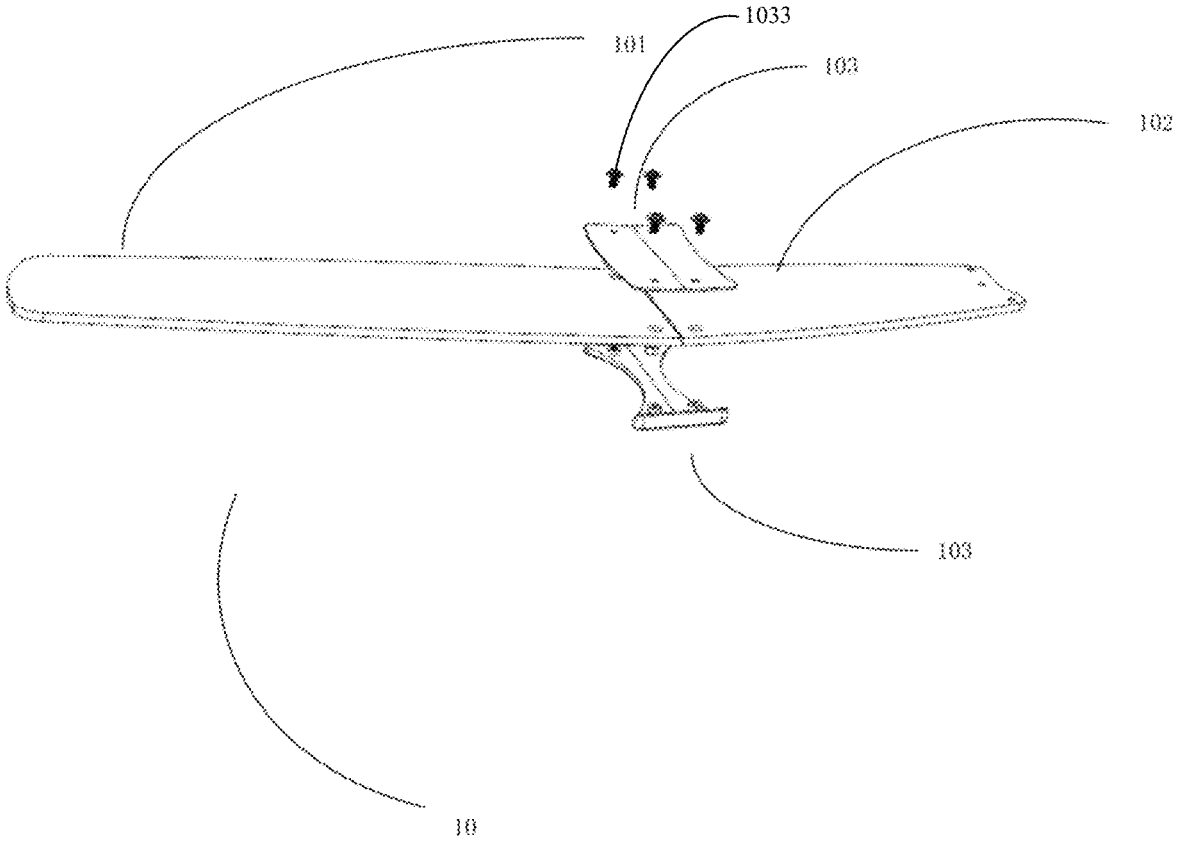
FIG. 1 shows a schematic structural diagram of a disassemblable fan blade according to an embodiment of the present disclosure.

10 Disassemblable fan blade
101 Outer fan blade
102 Inner fan blade
103 Fixing member
1031 Front cover plate
1032 Rear cover plate
1033 Fastening member

1034 Screw hole
1035 Limiting plate
1036 First angle
1037 Second angle
500 Ceiling fan light

DETAILED DESCRIPTION OF THE INVENTION

The following specific examples are provided to illustrate the embodiments of the present disclosure. Those skilled in the art can easily understand other advantages and benefits of the present disclosure based on the contents in this specification. The present disclosure may also be implemented or applied in different other specific embodiments, and various details in this specification may also be modified or changed in various ways based on different views and applications without departing from the spirit of the present disclosure. It should be noted that the following embodiments and the features in the embodiments can be combined with each other without conflict.

It should also be noted that the drawings in the following embodiments only schematically illustrate the basic concept of the present disclosure, therefore, only the components related to the present disclosure are shown in the drawings, and these drawings are not drawn in accordance with the number, shapes, and sizes of the components in actual implementation. The types, numbers, and proportions of the components in actual implementation may be subject to arbitrary changes, and the layout of the components may also be more complex.

Furthermore, in the present disclosure, descriptions such as "first", "second", etc. are used only for descriptive purposes and should not be understood as indicating or implying relative importance or implying the specific number of technical features. As a result, features designated as "first", "second", etc. may explicitly or implicitly include at least one of these features. In addition, the technical solutions in the various embodiments may be combined, but it must be assumed that those skilled in the art can implement them. If the combination of technical solutions is contradictory or cannot be implemented, it should be considered that the combination of these technical solutions does not exist and is not within the scope of protection required by the present disclosure.

A fan blade and a ceiling fan light are provided in the following embodiments of the present disclosure. By dividing a complete fan blade into a front section and a rear section, the volume of the package for transportation is reduced, the utilisation of packaging space is increased, and transportation costs are reduced. In addition, the fan blade is not easily damaged. Therefore, the current technical problems of low packaging space utilisation and easy breakage caused by the length of the fan blade are solved.

The principles and implementations of the fan blade and the ceiling fan light in the present disclosure are detailed in conjunction with the accompanying drawings, so that those skilled in the art can understand the fan blade and the ceiling fan light of the present disclosure without creative work.

FIG. 1 shows a schematic structural diagram of a disassemblable fan blade according to an embodiment of the present disclosure.

As shown in FIG. 1, the disassemblable fan blade 10 includes an outer fan blade 101, an inner fan blade 102, and a fixing member 103. The outer fan blade 101 is configured to be detachably connected to the inner fan blade 102, and the fixing member 103 is used to connect the outer fan blade 101 to the inner fan blade 102.

Specifically, the outer fan blade 101 is configured to be connected to the inner fan blade 102 through the fixing member 103, at which time the outer fan blade 101 and the inner fan blade 102 are in the same plane.

Specifically, the outer fan blade 101 is configured to be connected to the inner fan blade 102 at an angle to increase the air blowing area.

Specifically, as shown in FIG. 1, the volume of air flows generated by the fan blade when it is operation varies with the angle between the outer fan blade 101 and the inner fan blade 102.

In one embodiment, as shown in FIG. 1, the fixing member 103 includes a front cover plate 1031 and a rear cover plate 1032. The front cover plate 1031 and the rear cover plate 1032 are correspondingly arranged at a lower contact surface and an upper contact surface where the outer fan blade 101 and the inner fan blade 102 are connected. Limiting members passes through the corresponding screw holes 1034 and connecting holes to connect the outer fan blade 101 and the inner fan blade 102.

Specifically, the front cover plate 1031 is arranged at the lower contact surface, and the rear cover plate 1032 is arranged at the upper contact surface. The front cover plate 1031 and the rear cover plate 1032 connect the outer fan blade 101 and the inner fan blade 102 by fastening members 1033.

Specifically, the connecting ends of the outer fan blade 101 and the inner fan blade 102 are respectively provided with connecting holes for detachably connecting the outer fan blade 101 and the inner fan blade 102.

The ends of the front cover plate 1031 and the ends of the rear cover plate 1032 are correspondingly provided with screw holes 1034 for connecting the outer fan blade 101 and the inner fan blade 102. When installed, the screw holes 1034 are aligned with the connecting holes, so that the fastening members 1033 can pass through the screw holes 1034 and the connecting holes to connect the outer fan blade 101 and the inner fan blade 102. The strength of the disassemblable fan blade 10 is enhanced by the design of the front cover plate 1031 and the rear cover plate 1032, and the gravity center of the disassemblable fan blade 10 when in operation is moved inward by having the fixing member 103, making the fan's operation more stable. The fastening members 1033 are screws.

Figure 2:
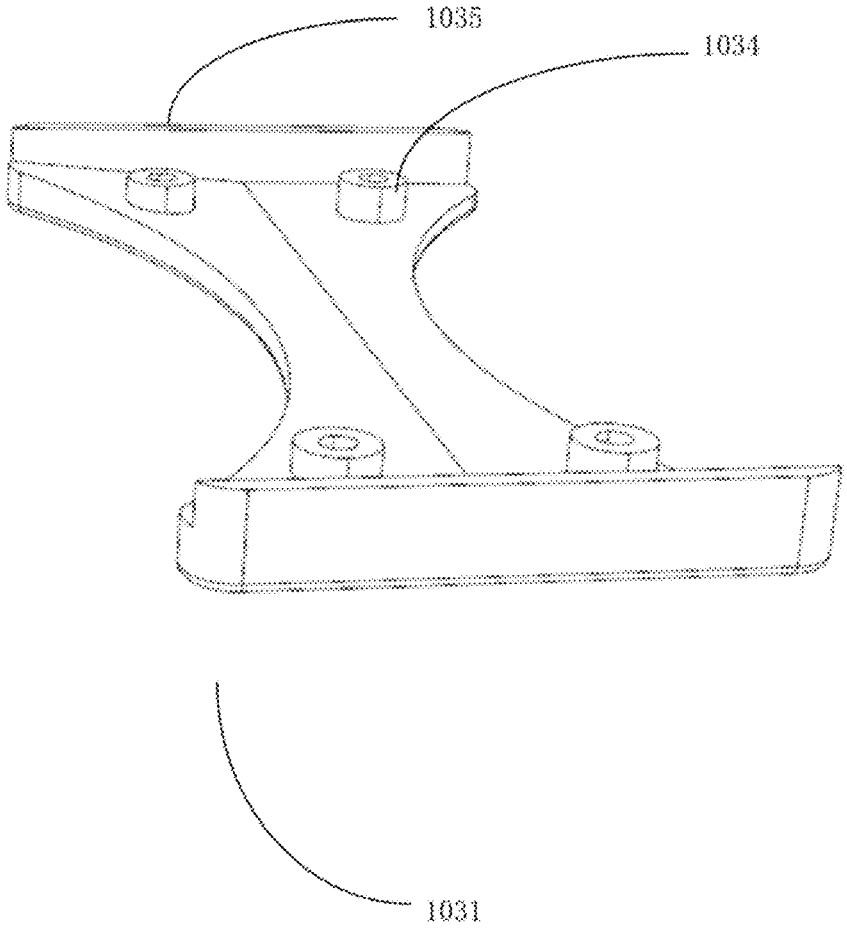
FIG. 2 shows a schematic structural diagram of a front cover plate according to an embodiment of the present disclosure.

In one embodiment, as shown in FIG. 2, limiting plates 1035 are provided on both sides of the front cover plate 1031 to assist in connecting the inner fan blade 102 and the outer fan blade 101. The limiting plates 1035 provided on both sides of the front cover plate 1031 are used to clamp the outer fan blade 101 and the inner fan blade 102, so as to fix the outer fan blade 101 and the inner fan blade 102 together, so that during installation the screw holes 1034 on the front cover plate 1031 and the rear cover plate 1032 can be more easily aligned with the connecting holes on the outer fan blade 101 and the inner fan blade 102.

Specifically, the screw holes 1034 protrude from the front cover plate 1031, and the height of the screw holes 1034 protruding from the front cover plate 1031 is less than the height of the limiting plate 1035 to facilitate the connection of the inner fan blade 102 and the outer fan blade 101.

Figure 3:
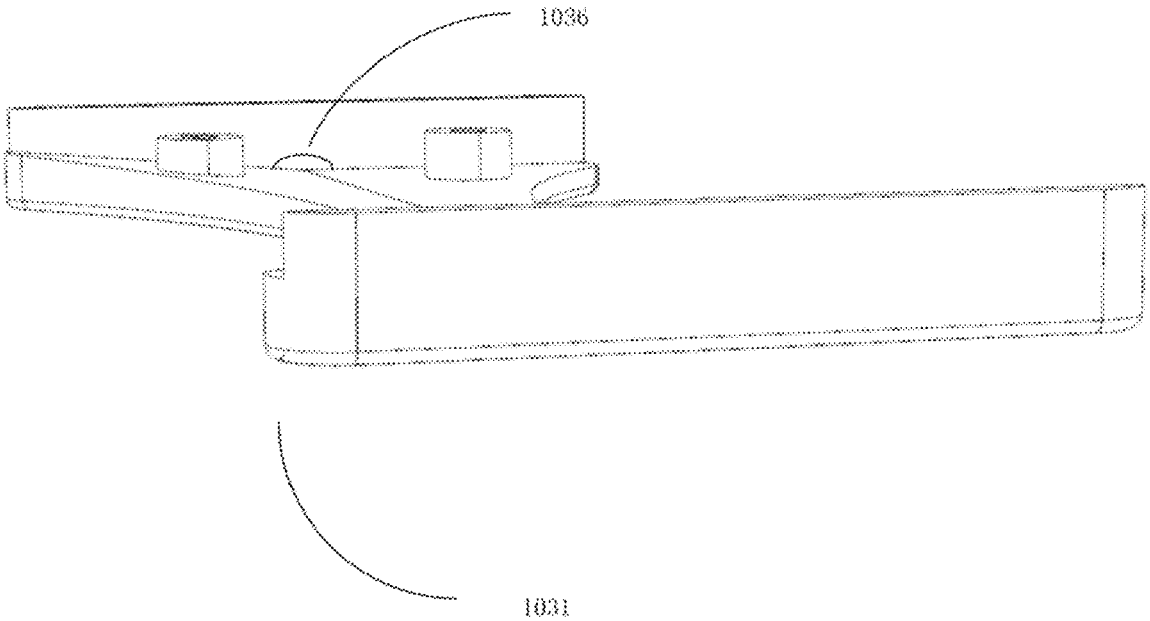
FIG. 3 shows a schematic structural diagram of the front cover plate according to an embodiment of the present disclosure.

In one embodiment, as shown in FIG. 3, the contact surface between the front cover plate 1031 and the outer fan blade 101 is at a first angle 1036 with the contact surface between the front cover plate 1031 and the inner fan blade 102. The first angle 1036 is complementary to a lower connecting angle between the outer fan blade 101 and the inner fan blade 102.

Specifically, the front cover plate 1031 is symmetrically arranged along a connecting line between the outer fan blade 101 and the inner fan blade 102. Due to that the outer fan blade 101 is connected to the inner fan blade 102 at an angle and the first angle 1036 is complementary to the lower connecting angle between the outer fan blade 101 and the inner fan blade 102, the front cover plate 1031 can better fit the outer fan blade 101 and the inner fan blade 102.

Figure 4:
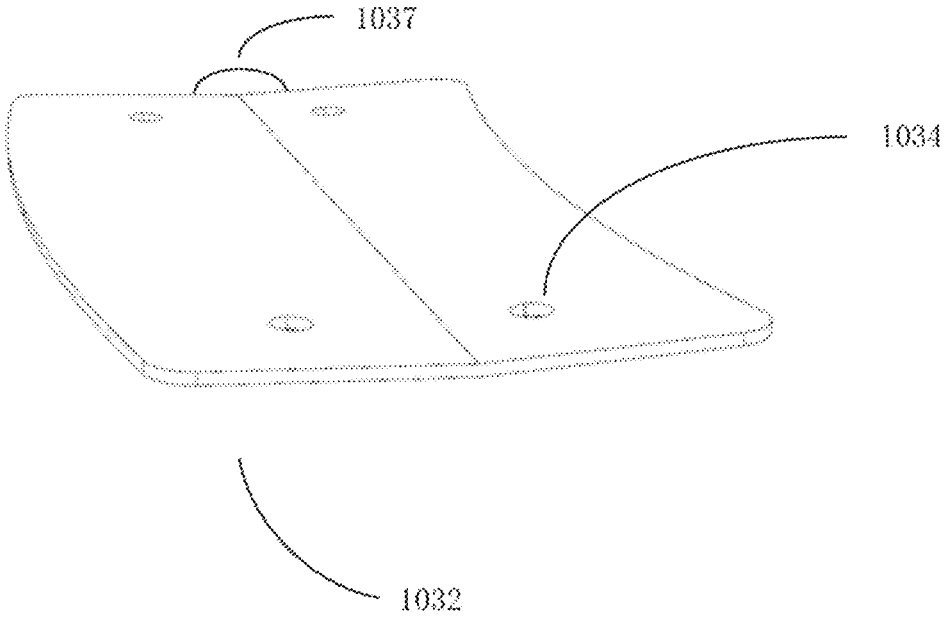
FIG. 4 shows a schematic structural diagram of a rear cover plate according to an embodiment of the present disclosure.

In one embodiment, as shown in FIG. 4, the contact surface between the rear cover plate 1032 and the outer fan blade 101 is at a second angle 1037 with the contact surface between the rear cover plate 1032 and the inner fan blade 102. The second angle 1037 is complementary to an upper connecting angle between the outer fan blade 101 and the inner fan blade 102.

Specifically, the rear cover plate 1032 is symmetrically arranged along the connecting line between the outer fan blade 101 and the inner fan blade 102. Due to that the outer fan blade 101 is connected to the inner fan blade 102 at an angle and the second angle 1037 is complementary to the upper connecting angle between the outer fan blade 101 and the inner fan blade 102, the rear cover plate 1032 can better fit the outer fan blade 101 and the inner fan blade 102.

In other words, each of the front cover plate 1031 and the rear cover plate 1032 have two symmetrical parts. When installed, the place where the symmetrical parts connect aligns with the place where the inner fan blade and the outer fan blade connect. The two symmetrical parts of the front plate 1031 are at an angle with each other, and this angle is substantially the same as the angle between bottom surfaces of the inner fan blade and the outer fan blade. Similarly, the two symmetrical parts of the rear plate 1032 are at an angle with each other, and this angle is substantially the same as the angle between top surfaces of the inner fan blade and the outer fan blade.

In one embodiment, the present disclosure also provides a ceiling fan light 500, where the fan light includes the disassemblable fan blade 10 of any of the embodiments of the present disclosure.

Figure 5:
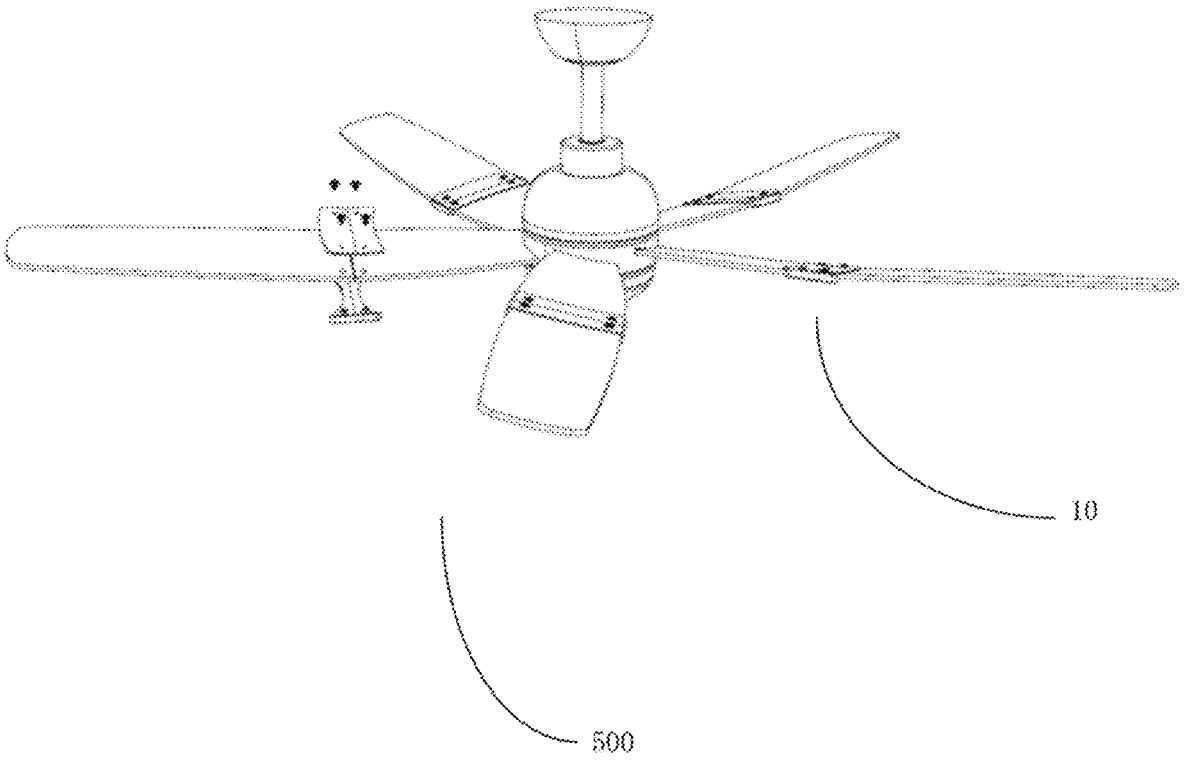
FIG. 5 shows a schematic structural diagram of a ceiling fan light according to an embodiment of the present disclosure.

Specifically, as shown in FIG. 5, the ceiling fan light 500 includes multiple disassemblable fan blades 10, a suspension rod, a lamp body, a joint covering, and a motor.

Specifically, one end of the suspension rod is connected to the ceiling, and the other end is connected to the joint covering. The motor is arranged in the joint covering, the inner fan blades 102 of the disassemblable fan blades 10 are connected to the motor, and the lamp body is arranged below the motor.

In summary, the outer fan blade and the inner fan blade are connected at an angle in the present disclosure, increasing the overall air blowing area of the fan. The fan blade in the present disclosure includes two sections, that is the inner fan blade and the outer fan blade, which reduces the packaging volume for transportation and increases the utilization of packaging space, thus reducing transportation costs and making it less prone to damage. Therefore, this application effectively overcomes various shortcomings in existing technologies and has high industrial utility value.

The above embodiments are only illustrative examples to explain the principles and effects of the present disclosure, and are not intended to limit the scope of the present disclosure. Anyone skilled in the art can modify or change the above embodiments without departing from the spirit and scope of the present disclosure. Therefore, any equivalent modifications or changes made by those skilled in the art in the relevant technical field without departing from the spirit and technical ideas disclosed in the present disclosure should still be covered by the claims of the present disclosure.

The invention claimed is:

1. A disassemblable fan blade, wherein a complete disassemblable fan blade is divided into an inner fan blade and an outer fan blade to reduce package volume for transportation of the disassemblable fan blade;

wherein the outer fan blade is detachably connected to the inner fan blade by a fixing member;

wherein the fixing member comprises:

a front cover plate located below both the outer fan blade and the inner fan blade, configured to connect to lower contact surfaces of the outer fan blade and the inner fan blade, and a rear cover plate located above both the outer fan blade and the inner fan blade, configured to connect to upper contact surfaces of the outer fan blade and the inner fan blade;

wherein the front cover plate and the rear cover plate are connected to the outer fan blade and the inner fan blade by a plurality of fastening members.

2. The disassemblable fan blade according to claim 1, wherein the outer fan blade is configured to be connected to the inner fan blade at an angle to increase a blowing area of the disassemblable fan blade.

3. The disassemblable fan blade according to claim 1, wherein a connecting end of the outer fan blade and a connecting end of the inner fan blade are respectively provided with a plurality of connecting holes for detachably connecting the outer fan blade and the inner fan blade.

4. The disassemblable fan blade according to claim 3, wherein a plurality of ends of the front cover plate and a plurality of ends of the rear cover plate are respectively provided with a plurality of screw holes for connecting the outer fan blade and the inner fan blade, wherein the plurality of screw holes corresponds to the plurality of connecting holes, and the plurality of fastening members passes through the plurality of screw holes and the plurality of connecting holes to connect the outer fan blade and the inner fan blade.

5. The disassemblable fan blade according to claim 4, wherein a limiting plate protruding upward from a top surface of the front cover plate is provided on each of two sides of the front cover plate to assist in connecting the inner fan blade and the outer fan blade.

6. The disassemblable fan blade according to claim 5, wherein the plurality of screw holes protrudes upward from a top surface of the front cover plate, and a height of the protruding screw holes on the front cover plate is less than a height of the limiting plate, so as to facilitate the connection of the inner fan blade and the outer fan blade.

7. The disassemblable fan blade according to claim 1, wherein a contact surface between the front cover plate and the outer fan blade is at a first angle with a contact surface between the front cover plate and the inner fan blade, and the first angle is the same as a lower connecting angle between the outer fan blade and the inner fan blade.

8. The disassemblable fan blade according to claim 7, wherein a contact surface between the rear cover plate and the outer fan blade is at a second angle with a contact surface between the rear cover plate and the inner fan blade, and the second angle is the same as an upper connecting angle between the outer fan blade and the inner fan blade.

9. A ceiling fan light, comprising the disassemblable fan blade according to claim 1.

* * * * *